166-274 SR
1/13/87 XR 4,635,721

United States Patent [19]
Sheffield et al.

[11] Patent Number: 4,635,721
[45] **Date of Patent: * Jan. 13, 1987**

[54] METHOD OF DISPLACING FLUIDS WITHIN A GAS-CONDENSATE RESERVOIR

[75] Inventors: Miller Sheffield; Robert S. Metcalfe, both of Tulsa, Okla.; James W. Calvin, Cairo, Egypt; Joseph J. Chaback, Tulsa, Okla.

[73] Assignee: Amoco Corporation, Chicago, Ill.

[ * ] Notice: The portion of the term of this patent subsequent to Oct. 22, 2002 has been disclaimed.

[21] Appl. No.: 789,869

[22] Filed: Oct. 21, 1985

Related U.S. Application Data

[63] Continuation-in-part of Ser. No. 566,205, Nov. 29, 1983, Pat. No. 4,548,267.

[51] Int. Cl.[4] ..... E21B 43/22
[52] U.S. Cl. ..... 166/268; 166/274; 166/305.1
[58] Field of Search ..... 166/268, 273, 274, 275, 166/305.1

[56] References Cited

U.S. PATENT DOCUMENTS

| | | | |
|---|---|---|---|
| 2,623,596 | 12/1952 | Whorton et al. | 166/274 |
| 2,720,265 | 10/1955 | Tracht | 166/273 X |
| 2,875,832 | 3/1959 | Martin et al. | 166/275 X |
| 3,149,668 | 9/1964 | Arendt | 166/273 X |
| 3,157,230 | 11/1964 | Connally, Jr. et al. | 166/274 |
| 3,223,157 | 12/1965 | Lacey et al. | 166/273 X |
| 3,354,953 | 11/1967 | Morse | 166/273 |
| 3,623,552 | 11/1971 | Vairogs | 166/274 |

FOREIGN PATENT DOCUMENTS 1559961 1/1980 United Kingdom .

OTHER PUBLICATIONS

Carlisle, et al., "$N_2$-Driven LPG Achieves Miscibility at High Temperatures", *Petroleum Engineer International,* 11-1982, pp. 70, 72, 77, 78 and 82.
Yarborough et al., "Solvent and Driving Gas Compositions for Miscible Slug Displacement", *Society of Petroleum Engineers Journal,* Sep. 1970, pp. 298-310.

*Primary Examiner*—Stephen J. Novosad
*Attorney, Agent, or Firm*—Scott H. Brown; Fred E. Hook

[57] ABSTRACT

A method is disclosed of displacing reservoir fluids through a subterranean retrograde or gas-condensate reservoir wherein a displacement fluid is introduced into the reservoir and it is displaced along with the reservoir fluids through the reservoir. The displacement fluid can be inherently miscible with the reservoir fluids at the temperture and pressure of the reservoir and comprises a nonoxidizing gas selected from a group consisting of carbon dioxide, flue gas, nitrogen, residue gas, and mixtures thereof in selected proportions.

12 Claims, 2 Drawing Figures

METHOD OF DISPLACING FLUIDS WITHIN A GAS-CONDENSATE RESERVOIR

BACKGROUND OF THE INVENTION

This application is a continuation-in-part of U.S. Ser. No. 556,205, filed Nov. 29, 1983, now U.S. Pat. No. 4,548,267, and assigned to the same assignee.

1. Field of the Invention

The present invention relates to a method of displacing fluids through a subterranean reservoir and, more particularly, to such a method for use in gas-condensate reservoirs.

2. Setting of the Invention

The recent trend in hydrocarbon discoveries in the western United States has been toward gas or gas-condensate reservoirs. In these reservoirs, the in-place fluids can be either one phase (liquid or gas) or two phase (gas and liquid) depending on both the pressure and the temperature of the reservoir. For example, a certain gas reservoir fluid at 300° F. and 3700 psia can be initially a one-phase, dense fluid and will remain as a single-phase as the pressure of the formation declines due to production. Further, the composition of the produced fluids from this reservoir will not change as the reservoir is depleted and this is true for any accumulation of this fluid composition where the reservoir temperature exceeds the cricondentherm, i.e., a maximum two-phase temperature. Although the fluids left in this reservoir during production remain in a one-phase state, the fluids produced through a wellbore and passed into surface separators (though the same composition) can enter into the two-phase state as the fluid temperature declines, which accounts for the production of condensate liquid at the surface from a gas (one phase fluid) in the reservoir.

However, a reservoir containing the same fluid composition of the previous example but at a reservoir temperature of 180° F. and an initial pressure at 3300 psia can also be initially in the single phase state when the reservoir temperature exceeds the critical temperature. As the reservoir fluid pressure declines because of production, the composition of the produced fluids remains constant until the dewpoint pressure is reached, below which liquid condenses out of the reservoir fluid which results in an equilibrium gas phase with a lower liquid content. The condensed liquid can become immobile within the formation unless its saturation in the pore spaces exceeds that required for fluid flow, as governed by the specific oil-gas relative permeabilities of the reservoir rock. In this particular example, the gas produced at the surface will have a lower liquid content and this process, which is called "retrograde condensation," will continue until a point of maximum liquid volume is reached. The term "retrograde" is used because the condensation of the liquids from a gas is usually associated with increasing, rather than decreasing, pressure. Further, a retrograde gas-condensate reservoir is synonymous with a gas condensate reservoir.

For qualitative purposes, the vaporization of the retrograde liquid aids the overall liquid recovery and can be evidenced by decreasing gas-oil ratios at the surface. The overall retrograde loss can be greater for lower reservoir temperatures, for high abandonment pressures, and for richer systems which have more available liquids. Also, the composition of the retrograde liquids is changed as pressure declines so that, for example, a 4% retrograde fluid volume at 750 psia can contain as much stable, surface condensate as a 6% retrograde fluid volume at 2250 psia.

It is particularly important to identify a gas-condensate reservoir early in the life of the field before substantial production has occurred, resulting in reduction of reservoir pressure, since an optimal depletion of a gas-condensate reservoir can be quite different from the depletion scheme for a non gas-condensate reservoir. Once the fluid in a gas-condensate reservoir has fallen below its dewpoint and liquid has condensed within the reservoir, it is quite difficult to thereafter recover this condensed liquid. Because the liquid content of a gas-condensate reservoir can be very economically valuable, and because through retrograde condensation a large fraction of this liquid can be left within the reservoir (at abandonment pressures), the practice of gas cycling to maintain reservoir pressure has been used in many condensate reservoirs.

In gas cycling, condensate liquids are removed from the produced wet-gas, usually in a surface gasoline plant and the residue or dry gas is returned to the reservoir through injection wells. This injected gas is used to partially maintain reservoir pressure and, therefore, is used to retard retrograde condensation. At the same time, the injected gas drives the wet-gas toward the producing wells; however, the reservoir pressure can still declined because the removed condensate liquids represent part of the wet-gas volume, unless additional drive or make up gas is added to the gas and injected into the reservoir. Gas cycling has several disadvantages, primarily the cost or lost revenues associated with reinjection, rather than sale, of the gas.

Other schemes have been proposed for the recovery of in-situ hydrocarbons, such as by miscible displacement. For instance, Great Britain Patent No. 1,559,961 discloses a process wherein a first slug of a light hydrocarbon is injected into a reservoir, followed by the injection of a second slug of carbon dioxide, and thereafter by the injection of a drive agent. U.S. Pat. No. 3,354,953 discloses a process wherein a calculated amount of a solvent, on the order of 3–100% of the reservoir pore volume and which is miscible with reservoir hydrocarbons, is injected into the reservoir and followed by a scavenging fluid, such as natural gas. A nitrogen-driven miscible slug has been shown to achieve miscibility with reservoir oil at a temperature below the critical temperature of propane (Koch, H. A., Jr. in Slobod, R. L.: "Miscible Slug Process", AIME (1957) Vol. 10, pgs. 40–47) and at very low pressures (Carlisle, and Montes, Reeves, and Crawford: "Nitrogen-Driven LPG Achieves Miscibility at High Temperatures", Petroleum Engineering International, November 1982, pgs. 70–82). The miscible displacement of crude oil by a gas slug and a drive slug, containing a large amount of nitrogen, was reported in Yarborough and Smith: "Solvent and Driving Gas Compositions for Miscible Slug Displacement", Society of Petroleum Engineers, September 1970, pgs. 298–310. Further, the injection of an inert gas following a miscibility-generating hydrocarbon gas flood in order to continue miscible displacement is disclosed in "Flue Gas Injection Underway in West Texas Block 31 Field", Petroleum Equipment Services, 30:1, 1967, pgs. 42–50.

Other references of interest are U.S. Pat. No. 2,720,265 and U.S. Pat. No. 3,149,668, wherein a dry gas, such as the gas produced from the reservoir, and injected into a reservoir prior to a secondary oil recovery method, such as a water flood.

While the above references disclose various concepts to increase *oil* recovery by miscible displacement, none of the references disclose or suggest a method of inhibiting or reversing the in-situ condensation of the valuable condensate liquids by injecting into the reservoir a displacement fluid which is inherently or develops in situ miscibility with the in-place reservoir fluids and where the displacement fluid comprises a nonoxidizing gas selected from the group consisting of carbon dioxide, flue gas, residue gas, nitrogen, and mixtures thereof.

SUMMARY OF THE INVENTION

The present invention is a method of displacing reservoir fluids through a subterranean retrograde or gas-condensate reservoir which is contemplated to overcome the foregoing disadvantages. Within the method of the present invention, a displacement fluid is introduced into the reservoir and is displaced along with the formation fluids through the reservoir. The displacement fluid can be inherently miscible with the formation fluids at the temperature and pressure of the reservoir, and further the displacement fluid comprises a nonoxidizing gas selected from the group consisting of carbon dioxide, flue gas, nitrogen, residue gas, and mixtures thereof. By way of the method of the present invention, the valuable reservoir condensate liquids are prevented from condensing within the reservoir by maintaining the required noncondensation temperature and pressure of the reservoir. In one embodiment of the present invention, a displacement fluid having both the nonoxidizing gas, as well as dry gas produced from the reservoir is injected into the reservoir and thereby followed with a drive slug of up to 100% of the nonoxidizing gas.

Further, by way of one embodiment of the present invention, even if the reservoir pressure has been reduced to below the dewpoint and condensation has occurred, this process can be reversed by injecting a nonoxidizing gas including $CO_2$ to revaporize the valuable condensate liquids.

DETAILED DESCRIPTION OF THE PREFERRED EMBODIMENTS

The present invention generally comprises a method of displacing reservoir fluids through a subterranean retrograde or gas condensate reservoir. In one embodiment of the present invention, a displacement fluid is introduced into the reservoir and the reservoir fluids displaced through the reservoir. The displacement fluid is inherently miscible with the reservoir fluids at the temperature and pressure of the reservoir. Further, the displacement fluid comprises a nonoxidizing gas selected from the group consisting of carbon dioxide, flue gas, nitrogen, residue gas, and mixtures thereof.

Figure 1:
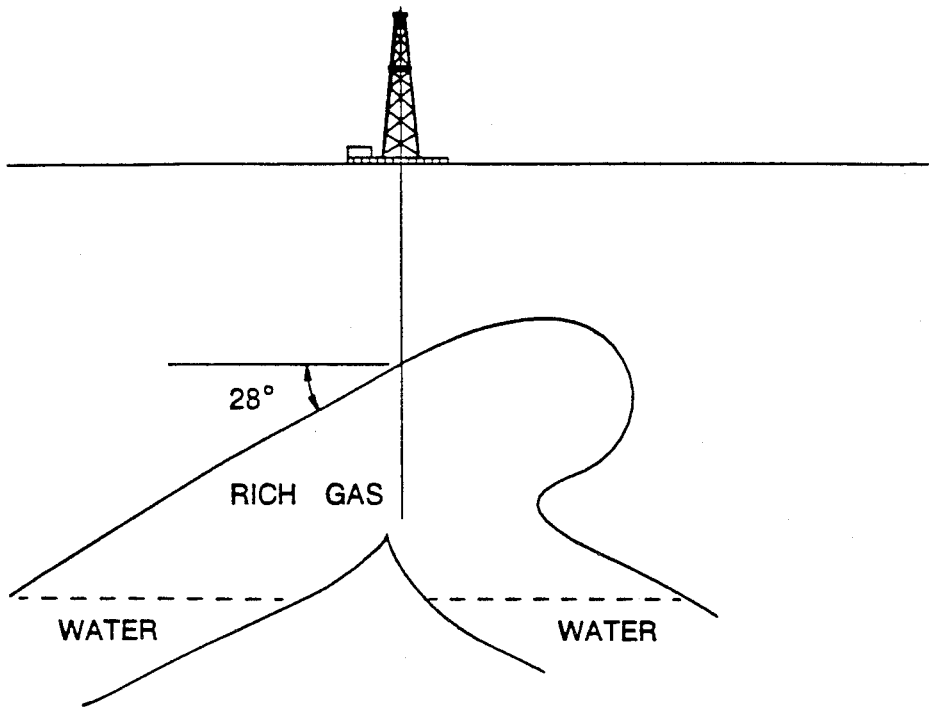
FIG. 1 is a elevational view of a wellbore penetrating a rich gas reservoir to be depleted by way of the method of the present invention.

As described previously, the recovery of fluids from a gas condensate reservoir can be difficult, especially in complicated structures, such as one that is inclined, folded and anticlined, as shown in FIG. 1. Within such a reservoir, the in-place rich gas i.e., a gas having a high condensate potential, lies within an area above a water interface and beneath a crest of the structure, and if the reservoir pressure is decreased below the reservoir dewpoint, then the gas condensate will condense within the formation, thereby being very difficult to recover.

Figure 2:
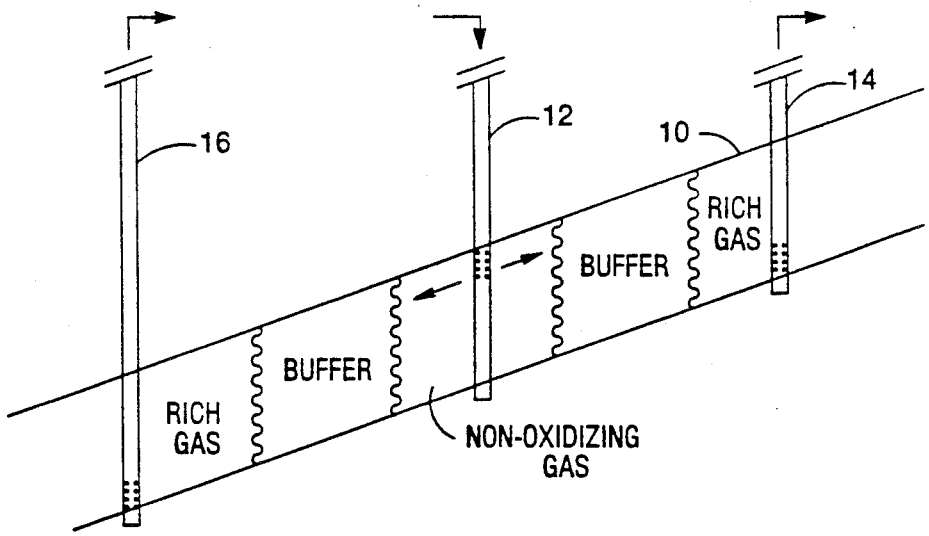
FIG. 2 is a elevational view of an injection well and two producing wells penetrating a rich gas reservoir to be produced by way of the method of the present invention.

For implementation of the present invention, the reservoir is to be penetrated by at least two wellbores, such as shown in FIG. 2. A gas reservoir 10 is penetrated by at least one injection well 12 and at least one production well, but herein two production wells are shown, 14 and 16. The injection well 12 is perforated adjacent the upper portion of the formation while the producing wells 14 and 16 are perforated adjacent the lower portion of the formation to aid in the recovery of formation fluids, as will be described in more detail below.

Within one method of the present invention, the rich gas within the formation is driven toward the production wells 14 and 16 by the injection of a bank or slug of displacement fluid comprising a nonoxidizing gas. The nonoxidizing gas can be selected from the group consisting of flue gas, $CO_2$, nitrogen, residue gas, or mixtures of these. Nitrogen can be used because it is much less compressible than hydrocarbon gas and thus less surface volume is needed to replace a given volume of hydrocarbon gas within the reservoir for pressure maintenance. However, $CO_2$ or a $CO_2$-rich gas is preferred because of its high miscibility with reservoir fluids. A nonoxidizing gas is preferred due to the fact that at certain wellbore temperatures, i.e., about 200°–250° F., the injection of an oxidizing gas, such as air and/or oxygen, can cause or initiate combustion at the surface of the formation, thereby damaging the formation and the wellbore equipment. The term "residue gas" means a dry gas produced from another source or is a dry gas produced from the reservoir and includes methane, ethane, propane, butane, and mixtures of these. The "dry gas" can also include gas produced from the formation from which some or all of the liquids have been stripped or gases from another reservoir location, but all are hydrocarbon gases. For example, a dry gas used in this method can comprise about 70% vol. methane, 25% vol. ethane, and the remainder comprised of other components.

For example, 100% nitrogen will develop miscibility within a sample sandstone core at about 15 ft of core length, but that injection of the displacement fluid will develop the same miscibility at about 3 ft of core length. Therefore, to enhance the development of the miscibility within the formation the displacement fluid is preferred to be injected prior to the injection of the drive slug.

The displacement fluid can be followed by the injection of a chase or drive fluid bank or slug comprising up to 100% vol. nonoxidizing gas, with any remainder being hydrocarbon gas. It has been determined that the nonoxidizing gas develops miscibility with the in-place reservoir fluids as long as the reservoir pressure is maintained above the original fluid dew point and thus recovery of the fluids from the reservoir is partly dependent on fluid injection patterns and sweep efficiencies.

It has been found that the nonoxidizing gas be preferably inherently miscible with the reservoir fluids. What is meant by this, is that the injected displacement fluid is miscible with the reservoir fluid from the start, i.e., is first contact miscible rather than having to develop miscibility. This capability to develop first contact miscibility has been found to depend largely on the content of the $CO_2$ in the displacement fluid. In some situations a mixture of nitrogen and residue gas can increase the reservoir's dew point; however, a mixture of $CO_2$ and residue gas can maintain or depress the reservoir's dew point, thereby allowing greater fluid recovery from the reservoir. Obviously, the preferred proportion of $CO_2$ is dependent upon the original reservoir characteristics. The first contact miscible nonoxidizing gas can displace in-place hydrocarbons without the additional pore volumes of injection gas needed to create or develop miscibility.

An unexpected development through the use of the present invention is that a reservoir which has had some condensation occur can be reversed, i.e., have its condensed fluids revaporized, and thus made recoverable. It has been found that a $CO_2$-rich nonoxidizing gas, and preferably $CO_2$ alone, be used as the displacement fluid. Carbon dioxide can promote the revaporization by virtue of its solvent action with hydrocarbons, as is well known. The dew point of the reservoir fluid is also depressed because of this solvent action.

The size or volume of the displacement fluid used is determined by the particular reservoir conditions; however, calculations indicate that a size of at least about 1 volume percent of the hydrocarbon pore volume of the reservoir is sufficient for providing improved fluid displacement and surface liquid recovery. Also, the displacement fluid can include at least about 50 volume percent of the fluids produced from the reservoir, i.e., in the form of dry gas. Preferably, however, the first portion of the displacement fluid is equivalent to at least about 10 volume percent of the hydrocarbon pore volume of the reservoir and further, that the displacement fluid includes at least about 65 volume percent of the fluid produced from the reservoir, i.e., in the form of dry gas.

In one particular test of the present invention, nitrogen was used as the nonoxidizing gas to aid in displacing a rich gas, i.e., a condensate fluid which comprised about 65 mole volume percent of methane, about 12 mole volume percent ethane, about 21 mole volume percent propane and higher hydrocarbons, and about 2 mole percent of other components. In this test, the rich gas to be produced from the reservoir, having a reservoir structure as shown in FIG. 1, had a dew point pressure of approximately 5080 psia (35,025 KPa). This reservoir pressure was determined to be above the dew point by approximately 150 psia (1034 KPa) at the crest (or upper portion of the reservoir), and by approximately 300 psia (2068 KPa) at the gas-water interface. It was also determined that the liquid components condensed within this reservoir very rapidly if the pressure in the reservoir was reduced to less than the dew point pressure, which would result in the substantial loss of the propane and other higher hydrocarbons. The reservoir was analyzed to determine the best method of injecting the reservoir fluid to obtain as good as a sweep of the rich gas through the reservoir as possible. Based upon this analysis, it was determined that a very wide areal sweep could be obtained by displacing the the rich gas from an injection well toward the production wells (as shown in FIG. 2) and that good vertical sweep could be achieved by introducing the displacement fluid and drive slug through the upper portion of the injection well extending through the reservoir and producing the rich gas through a lower portion of the production wells extending through the reservoir. The contact of the nitrogen with the rich gas at the particular reservoir temperature and pressure caused a small portion of the liquids, such as the propane and the higher hydrocarbons to condense from the rich gas; however, such condensation was far less than that calculated if only nitrogen was used as a drive fluid and was far more economically attractive than if straight hydrocarbon gas was used.

Table 1 sets forth the volume percent of rich gas that is condensed as fluids within the reservoir are contacted by mixtures of a nonoxidizing gas, such as nitrogen, and fluids produced from the reservoir, such as 70% vol. methane. As illustrated in Table 1, the volume percent of fluids condensed decreases as the ratio of the produced fluids to nitrogen in the mixture is increased.

TABLE 1

FLUID CONDENSATION ON CONTACT OF RICH GAS WITH MIXTURES OF NITROGEN AND PRODUCED FLUIDS

| Mixtures of Nitrogen and Produced Fluid | | Fluid Condensed Within the |
|---|---|---|
| Nitrogen (volume percent) | Produced Fluids (volume percent) | Reservoir (volume percent) |
| 50 | 50 | 29.1 |
| 35 | 65 | 27.6 |
| 20 | 80 | 27.3 |

Also, the effect of changes in the volume of the displacement fluid is illustrated in Table 2, wherein the volume percent of the displacement fluid is a mixture of volume percent nitrogen and 65 volume percent fluids produced from the reservoir (primarily methane) and is then contacted by rich gas produced from the reservoir. As illustrated by this table, the volume percent of the fluids condensed in the reservoir decreases as the volume of the displacement fluid is increased.

TABLE 2

FLUID CONDENSATION ON DISPLACEMENT OF RICH GAS THROUGH A SUBTERRANEAN RESERVOIR BY FIRST CONTACTING THE RICH GAS WITH A VOLUME OF A BUFFER SLUG COMPRISING NITROGEN AND PRODUCED FLUIDS FOLLOWED BY DISPLACING THE BUFFER COMPOSITION AND RICH GAS THROUGH THE RESERVOIR

| Volume of Buffer Slug (volume percent of the hydrocarbon pore volume of the reservoir) | Fluid Condensation in the Reservoir (volume percent) |
|---|---|
| 0 | about 35.5 |
| 1 | 30.8 |
| 5 | 29.3 |
| 10 | 27.6 |
| 20 | 25.2 |

Amoco Production Company has started the injection of a buffer slug of the present invention into its Anschutz Ranch East field and particularly into a retrograde gas-condensate reservoir. Five injection wells in a nine-spot spacing are currently being used with injection rates of about 20 to about 50 MMcfd/well. The injection of the nitrogen plus fluids produced from the reservoir is maintained at a high enough pressure to maintain the reservoir pressure between about 5,000–5,800 psia. The method of the present invention is being utilized because the liquid dropout under reservoir conditions in this reservoir is as high as 40 percent of the hydrocarbon pore volume and the fluid dew point was prior to initiation of the buffer slug injection within 150 psia of the original reservoir pressure.

Wherein, the present invention has been described in particular relation to the drawings attached hereto, it should be understood that other and further modification, apart from those shown or suggested herein, may be made within the scope and spirit of the present invention.

We claim:

1. A method of displacing reservoir fluids through a subterranean retrograde or gas-condensate reservoir, comprising:

introducing a displacement fluid into the reservoir and displacing it and the reservoir fluids through the reservoir;

wherein the displacement fluid is inherently miscible with the reservoir fluids at the temperature and pressure of the reservoir; and further wherein the displacement fluid comprises a nonoxidizing gas selected from the group consisting of carbon dioxide, flue gas, nitrogen, residue gas, and mixtures thereof.

2. The method of claim 1 wherein the displacement fluid comprises carbon dioxide and residue gas.

3. The method of claim 1 wherein the residue gas is a dry gas produced from the reservoir.

4. The method of claim 1 wherein the reservoir pressure is below the dew point of the reservoir fluids.

5. The method of claim 1 wherein the displacement fluid comprises at least about 50 volume percent of the fluid produced from the reservoir.

6. The method of claim 1 wherein a first portion of the displacement fluid is equivalent to at least about 1 volume percent of the hydrocarbon pore volume of the reservoir and further comprises at least about 50 volume percent of fluids produced from the reservoir.

7. A method of inhibiting in-situ condensation of reservoir fluids in a retrograde or gas condensate reservoir, comprising:

injecting a displacement fluid inherently miscible with the reservoir fluids at the temperature and pressure of the reservoir, in an amount sufficient to maintain the reservoir pressure above the original dew point of the reservoir fluids, the displacement fluid comprising a nonoxidizing gas selected from the group consisting of carbon dioxide, flue gas, nitrogen, residue gas, and mixtures thereof, and introducing a drive slug of the nonoxidizing gas used in the displacement fluid.

8. The method of claim 7 wherein the displacement fluid comprises carbon dioxide and residue gas.

9. The method of claim 7 wherein the residue gas is a dry gas produced from the reservoir.

10. A method of reversing in-situ condensation of reservoir fluids in a retrograde or gas condensate reservoir wherein the reservoir pressure is below the dew point of the original reservoir fluids, comprising:

injecting a displacement fluid inherently miscible with the reservoir fluids at the temperature and pressure of the reservoir in an amount sufficient to maintain the reservoir pressure at or above the dew point of the reservoir retrograde fluids, and mixtures of the displacing gas and the retrograde fluids, the displacement fluid comprising a nonoxidizing gas selected from the group consisting of carbon dioxide, flue gas, nitrogen, residue gas, and mixtures thereof, and introducing a drive slug of the nonoxidizing gas used in the displacement fluid.

11. The method of claim 10 wherein the displacement fluid comprises carbon dioxide and residue gas.

12. The method of claim 10 wherein the residue gas is a dry gas produced from the reservoir.

* * * * *